United States Patent [19]

McArthur

[11] Patent Number: 5,049,020

[45] **Date of Patent: * Sep. 17, 1991**

[54] DEVICE FOR POSITIONING AND STABBING CASING FROM A REMOTE SELECTIVELY VARIABLE LOCATION

[75] Inventor: James R. McArthur, Tishomingo, Okla.

[73] Assignees: John Harrel; Charlena Harrel, both of Lindsay, Okla. ; a part interest

[ * ] Notice: The portion of the term of this patent subsequent to Mar. 24, 2004 has been disclaimed.

[21] Appl. No.: 517,567

[22] Filed: May 1, 1990

Related U.S. Application Data

[63] Continuation of Ser. No. 203,252, Jun. 2, 1988, Pat. No. 4,921,386, which is a continuation-in-part of Ser. No. 22,076, Mar. 5, 1987, abandoned, which is a continuation of Ser. No. 574,129, Jan. 26, 1984, Pat. No. 4,652,195.

[51] Int. Cl.[5] ..... B65G 47/08

[52] U.S. Cl. ..... 414/22.51; 175/85; 294/88; 294/902; 414/753; 414/745.2; 414/744.8

[58] Field of Search ..... 414/732, 744.8, 738, 414/739, 735, 729, 22.68, 22.71, 753, 751, 745.1, 730, 22.63, 22.61, 22.58, 22.51, 745.2; 175/52, 85; 901/39; 294/88, 902

[56] References Cited

U.S. PATENT DOCUMENTS

| | | | |
|---|---|---|---|
| 2,206,184 | 7/1940 | Graham et al. | 255/1 |
| 2,416,815 | 3/1947 | Calhoun . | |
| 2,450,934 | 10/1948 | Calhoun | 255/35 |
| 2,615,681 | 10/1952 | True | 255/35 |
| 2,828,024 | 3/1958 | True . | |
| 3,112,830 | 12/1963 | Podlesak . | |
| 3,467,262 | 9/1969 | Reed . | |
| 3,514,822 | 6/1970 | Guier | 24/263 |
| 3,533,516 | 10/1970 | Guier . | |
| 3,840,128 | 10/1974 | Swoboda, Jr. et al. . | |
| 3,921,823 | 11/1975 | Bourree et al. . | |
| 3,976,207 | 8/1976 | Schultz . | |
| 4,077,525 | 3/1978 | Callegari et al. . | |
| 4,274,777 | 6/1981 | Scaggs | 414/22 |
| 4,295,527 | 10/1981 | Russe | 166/315 |
| 4,403,897 | 9/1983 | Willis | 414/22 |
| 4,652,195 | 3/1987 | McArthur | 414/22.51 |
| 4,681,158 | 7/1987 | Pennison | 166/77.5 |
| 4,921,386 | 5/1990 | McArthur | 414/22.51 |

OTHER PUBLICATIONS 1988-1989 General Services and Products Catalog of Weatherford Sales and Service.

*Primary Examiner*—Frank E. Werner

*Attorney, Agent, or Firm*—Laney, Dougherty, Hessin & Beavers

[57] ABSTRACT

A casing stabbing apparatus which includes a derrick bracket subassembly for attachment to a derrick, and a boom having an end pivotally connected to the bracket assembly for pivotation about a vertical axis and about a horizontal axis. A pair of arcuate casing gripping jaws is pivotally connected to the second end of the boom. A piston and cylinder assembly extends between the jaws to selectively converge and diverge the jaws. A second piston and cylinder assembly extends between the bracket assembly and the boom to elevate the boom by pivotation about a horizontal pivotal axis. A third piston and cylinder assembly extends between the bracket assembly and the boom to swing the boom laterally in pivotation about a vertical axis. A remote automatic control subassembly enables the casing stabbing operation to be carried out from a remote location by the use of a hand held wand.

8 Claims, 3 Drawing Sheets

DEVICE FOR POSITIONING AND STABBING CASING FROM A REMOTE SELECTIVELY VARIABLE LOCATION

RELATED APPLICATION

This is a continuation of copending application U.S. Ser. No. 203,252 filed on June 2, 1988, now U.S. Pat. No. 4,921,386, which is a continuation-in-part of U.S. patent application Ser. No. 022,076 filed on Mar. 5, 1987 and entitled "CASING STABBING AND POSITIONING APPARATUS", now abandoned which application is a continuation of U.S. application Ser. No. 574,129, filed Jan. 26, 1984, now U.S. Pat. No. 4,652,195.

BACKGROUND OF THE INVENTION

1. Field of the Invention

This invention relates to apparatus for engaging and for positioning large diameter well casing, and more particularly, to an apparatus which can be mounted in a derrick extending upwardly over a drilling rig platform, and then can be controlled from a remote selectively variable location to engage a section of oil or gas well casing hanging from a crown block in the derrick, and can then be further used to steer and align the section of well casing so that the threads at one end thereof are prevented from cross threading with the threads of a casing section therebelow at the time when the two casing sections are threaded together.

2. Brief Description of the Prior Art

Various types of apparatus have been provided to assist in the manual alignment and interconnection of sections of elongated drill pipe and other tubular stock used in the drilling and completion of oil and gas wells. Most of these devices employ mechanical advantage, and in many cases hydraulics, to cause a pair of gripping elements or tongs to surround and engage the tubular stock, and then to use leverage or hydraulics to swing the tubular stock to a precise position within a derrick and generally immediately over the well head at which a second section of the tubular stock is located. The manipulation described is used to position the upper section of tubular stock over the one suspended in the well bore at the well head so that the two ends thereof can be threaded together and the string of tubular members projecting down into the well bore extended by such threaded addition.

A number of patents have also been proposed which handle drill pipe and drill collars from a location in the derrick by engaging sections or joints of such drill pipe or drill collar and swinging these joints to a racking location where the drill pipe is stored pending use of the drill pipe. In general, the problems of handling drill pipe differ significantly from the problems which are encountered when very large diameter casing sections are to be engaged and moved from one location to another, particularly when the objective is to align a joint of the drill pipe with the upper end of a joint of drill pipe suspended at the rotary table and projecting down into the well bore. One reason for this difference in the problems encountered is that the drill pipe is usually of much smaller diameter than large diameter casing, and consequently may have as much as 200 pounds per foot weight differential which is very significant, and, perhaps most importantly, has very coarse threads which are difficult to misalign as the suspended upper joint of the drill pipe is brought into end-to-end abutting relationship with the suspended pipe joint for threaded interconnection of the two.

Sections of casing, on the other hand, carry relatively fine threads, and it is easy to cross thread the threaded female or pin end of one casing section with the box end of another section. Such cross threading will result from very slight misalignment of the axis of the casing section being lowered in the derrick from the crown block to effect such threaded engagement, with the axis of the uppermost section of casing suspended in the well bore by the engagement of slips at the well head.

U.S. Pat. No. 4,077,025 issued in 1978 to Callegari et al discloses an apparatus which can be mounted in an oil well derrick in order to manipulate and maneuver joints or lengths of drill pipe into or out of one or more fingerboards which are mounted above the apparatus in the derrick. The apparatus includes a pipe manipulating arm which can move in two planes of movement, but cannot be rotated up or down on the derrick to remove the drill pipe handling apparatus as an obstruction within the enclosed area inside of the derrick. A pipe manipulating arm carries a pipe gripping hand at one end thereof, and the pipe manipulating arm is telescoped to facilitate extension of the length of the arm when desired. Further, the gripping hand is rotatably attached to one end of the arm so that it can be oriented at various angles with respect to the drill pipe. The system is hydraulically actuated. The telescoping arm extends and retracts along a single invariant line.

This apparatus is useful, as it is described in this patent, solely for the racking of drill pipe of relatively smaller diameter, and would not be useful for stabbing and manipulating large diameter casing. The basic arm which projects inwardly from the side of the derrick must project at a right angle to the derrick and there is no capability in the Callegari apparatus of extending this arm at a selected angle with respect to the plane of the side of the derrick.

Swoboda et al U.S. Pat. No. 3,840,120 is also a racking arm which is intended to be mounted on the floor of a drilling rig and used for racking drill pipe, drill collars and riser pipe. It is not adapted, nor can it be used effectively, for stabbing casing from a point in the derrick, particularly large diameter casing. The apparatus includes a racking arm which has a telescoping boom which is supported at one of its ends and has a free cantilevered end opposite the supported end. A pipe gripping head is secured to the cantilevered end of the boom for clamping about drill pipe sections and drill collars. The manner in which the cooperating jaws of the Swoboda apparatus are hingedly interconnected requires the jaws to have a significant movement space in order to open and close.

The Swoboda apparatus is very heavy and very complicated and functions primarily as a device which must be supported on the rig floor and cannot be mounted in the derrick. Moreover, the jaws which are used in the Swoboda device for engaging the drill pipe are limited in size to drill pipe which probably will not exceed about eight inches in maxiumum diameter.

Finally, the Swoboda racking arm cannot be operated from a remote, selectively variable location so as to control the movement of drill pipe carried at one end of the arm while the operator of the apparatus is moving around from one location to another to sight in the drill pipe during its movement.

U.S. Pat. No. 2,615,681 to True describes an apparatus for handling drill pipe so as to facilitate the coupling and uncoupling of sections of drill pipe being lowered into, or removed from, a well bore. The apparatus includes a carriage mounted on a trackway which is positioned on the floor of a derrick. An extensible and retractable arm is mounted on a housing which in turn is mounted on the carriage. The arm carries on a free end, a hook or fork adapted to grasp and release a vertical stand of pipe. Power devices are provided for moving the carriage along the track, and for actuating the extensible and retractable arm and the hook which is carried on the free end of the arm. The apparatus is complicated in its construction, and is incapable of being mounted without difficulty anywhere except on the rig floor. Moreover, the construction of the drill pipe handling apparatus is such that it is not well adapted for engaging and positioning large casing sections having diameters in excess of 12 inches. The True apparatus makes no provision for yawing or pivoting the boom about a vertical axis to achieve side-to-side motion.

U.S. Pat. No. 2,450,934 to Calhoun describes an apparatus for hydraulically actuating tongs used for making and breaking joints of drill pipe as the pipe is moved into and out of a well bore. The tongs employed are mounted on a post extending upwardly from a platform which can be positioned on the derrick floor. A detachable control head is utilized on the tong, and is operable by means of hydraulic power facilitating operation of the tong from a remote location by an operator. A hydraulically actuated work positioning and orienting arm is mounted on the supporting post, and its movement is controlled from a remote location. A number of complicated mechanical linkages are required for operation of the Calhoun apparatus, and the nature of its construction is such that it must be supported on the rig floor, rather than mounted in the derrick.

Willis U.S. Pat. No. 4,403,897 is a self-centering clamp for downhole tubulars which includes jaw members which can be caused to move vertically relative to a drilling platform by means of a hydraulic cylinder, and can then be caused to move in a convergent fashion with respect to each other so as to clamp upon a pipe section and guide the pipe section downwardly for engagement with a second section of pipe. The jaws are hydraulically actuated. Because the Willis structure is intended to lift a tubular, such as a section of drill pipe, from a horizontal to a vertical position before lowering it for engagement with a lower section of drill pipe, the apparatus is more complicated than the apparatus which would be needed to position sections of drill pipe or casing suspended from the crown block of a derrick. The clamping jaws utilized do not, in themselves, allow for any spinning or rotative movement of the tubular member which is engaged by the clamps.

In Reed U.S. Pat. No. 3,467,262, a pipe stabbing apparatus is disclosed in which an extensible boom is utilized for extending and retracting a pair of pivotal jaws capable of holding and releasing joints of drill pipe. The extensible boom may be pivoted in a horizontal plane through a desired angle to enable the stabbing head which carries the jaws to reach the points where the drill pipe is needed. A hydraulic piston and cylinder assembly is connected to the extensible boom for pivoting it about a vertical axis in order to vary the angular position of the extensible boom on its foundation. The pipe stabbing head on the end of the boom carries a jaw which is mechanically actuated to open and close the jaw about a section of drill pipe. The jaw provided is inadequate in size, structural strength and mode of operation for gripping extremely large diameter tubulars, such as casing sections exceeding about ten inches in diameter, and no provision is made for the spinning or turning of the suspended casing or drill pipe section within the jaw once engagement is effected.

Podlesak U.S. Pat. No. 3,112,830, although not relating to oil field tubular goods in its application, does relate to a polehandling device which includes an elongated extensible boom which is pivotally connected to a massive support structure. A hydraulic cylinder is provided for elevating and lowering the boom, and a pair of convergent and divergent jaws are carried on the free end of the boom. These jaws are clamped about the tubular by means of a hydraulic piston and cylinder arrangement which pivots the jaws about pivot points located near one end of the jaws. The jaws can also be made to undergo a yawing movement by means of a hydraulic piston and cylinder assembly. Due to the massive character of the support structure upon which the boom and associated hydraulics are carried, the Podlesak structure would be unsuitable for use in stabbing tubular goods suspended from the crown block of a derrick of the type used in the drilling and completion of oil and gas wells.

Guiers U.S. Pat. No. 3,514,822, discloses a transporter for manual slips used to engage and support a drill pipe section in a rotary table. The transporter apparatus includes a boom having a pipe gripping jaw at one end thereof which is mounted upon a supporting platform or table, which in turn is rested upon the rig floor. The boom is moved from a position offset from the drill pipe section to be engaged into a position where the jaws can grip the drill pipe. This pivotal motion of the boom is accomplished by a hydraulic piston and cylinder assembly which can be operated from a remote location at which a hydraulic control console is located.

Other stabbing devices for engaging and positioning tubular elements such as drill pipe and casing, during the making up of strings of drill pipe and casing are disclosed in U.S. Pat. Nos. 2,822,024; 2,820,783 and 3,467,262.

Graham et al U.S. Pat. No. 2,206,184 discloses a stabbing guide which can be mounted in the derrick during an oil well drilling and completion operation to center and steady a casing section while it is aligned with, and joined to, a preceding section going into the well bore. The apparatus employed includes a guiding and restraining or steadying member which is used to partially engage the suspended casing section, and also includes a supporting carriage which is mounted in the derrick, and which permits the guiding and steadying member to be moved laterally from side-to-side of the derrick. The guiding and steadying member is merely a V-shaped supporting surface which can be moved in order to push a casing section contacted thereby. It is also possible to vary the angulation formed between the two members forming the V configuration in the guiding and steadying member in order to accommodate casing sections of varying sizes.

A similar device is shown in Guier U.S Pat. No. 3,533,516. Here however, the portion of the apparatus which is angulated to permit engagement with the tubular element being connected is carried on the end of, and formed integrally with, an elongated arm which is pivotable about a horizontal axis to cause the arm to be yawed or swiveled in a horizontal plane. The arm and the hydraulic piston and cylinder assembly used for imparting the yawing motion are mounted on an upright stand or standard, which in turn is supported on a base plate which can be rested on the rig floor or drilling platform.

A subterranean well pipe positioning apparatus is disclosed in Scaggs U.S. Pat. No. 4,274,777. In the Scaggs patent, an apparatus is disclosed for engaging and guiding suspended pipe section joints which hang from the crown block of a derrick. The apparatus includes an elongated boom which is mounted to the derrick through a rotary axle to permit pivotation upwardly and downwardly. A power cylinder is provided for rotating the apparatus about the horizontal rotary axle. A pair of guide jaws are pivotally attached to the outer end of the boom and are actuated by a cylinder which causes the jaws to open and close with respect to each other in order to engage a pipe to be selectively positioned.

A different approach to the engagement and selective guiding of a suspended casing section during section coupling operations is disclosed in Russe U.S. Pat. No. 4,295,527. In the Russe patent, the apparatus employed is first clamped or secured by a lower clamp assembly to the upper end of a lower casing section which protrudes slightly above the rig floor. Projecting upwardly, and offset from the axis of this casing section, is an upright member which extends substantially parallel to the axis of the lower casing section and a substantial distance above the upper end of the lower casing section. The upper end of the upright member carries an upper gripping assembly which includes a pair of pivotally mounted jaws which can be used to grip and engage the descending suspended casing section which is to be screwed into the lower casing section. The jaws are hydraulically actuated to clamp against the casing, but no provision is made to permit the casing to rotate on the swivel from which it is suspended. Moreover, it is necessary with the Russe structure to have a sufficient amount of the lower casing section extending upwardly from the rotary table to permit the lower clamp assembly to be clamped thereto.

BRIEF DESCRIPTION OF THE PRESENT INVENTION

The present invention is an improved casing stabbing apparatus which can be easily hoisted into the upper portion of a drilling derrick and stably secured to one of the cross members of the derrick. The apparatus is completely automated and hydraulic in its operation. An important feature of the apparatus is the fact that it can be very effectively controlled from a selected remote location on the derrick floor, and the operator of the apparatus is able to move around, at will and randomly, on the derrick floor so as to sight in the casing section which is engaged by the apparatus. Such operator can therefore direct the automatic hydraulic actuation of the apparatus to finely adjust the position of the casing as it is brought into alignment with the section of the casing suspended in the well bore and having its upper end portion held by the slips at the rotary table.

The apparatus of the invention is much less bulky and massive than many types of apparatus previously proposed for this purpose, such as that which is illustrated and described in the Swoboda et al patent to which reference has hereinbefore been made. The apparatus is movable in several planes of motion, and can be mounted on the derrick near a corner of the derrick if desired, and thus affords little interference with operations which may be proceeding along one side of the derrick. In other words, the casing engaging arm or boom can be angled with respect to the plane of the side of the derrick by pivoting movement up or down when this is desirable or needed.

The apparatus is especially well adapted for the engagement of very large diameter casing, such as casing having a diameter of up to thirty-six inches. In this respect, it can be used where the types of apparatus which have previously been used for racking drill pipe having an outside diameter of less than nine inches would be ineffective.

Broadly described, the casing stabbing apparatus of the invention includes a derrick bracket subassembly which is constructed to permit the entire casing stabbing apparatus to be quickly secured to a structural member or cross beam of the drilling derrick in which the apparatus is to be mounted and used. Detachably connected to the derrick bracket subassembly is a boom and jaw subassembly. There is also detachably connected to the derrick bracket subassembly, a remote control panel which acts as the distribution point or manifold from which hydraulic fluid is directed to a selected one or more of several hydraulic piston and cylinder assemblies used to cause the boom and the well casing jaws to undergo motion in several planes of movement. The remote control panel subassembly thus includes a plurality of solenoid-type valves which can be selectively electrically opened. The leads required to operate this electrical circuitry pass through a single power cable to a manually manipulatable wand or joy stick which can be carried in one hand by an operator as he moves about the drilling platform of the rig.

The remote control panel subassembly includes only four lines which extend to the derrick floor. Two of these are hydraulic lines which function, respectively, to deliver power fluid from a pump to the casing stabbing apparatus mounted in the derrick and to return hydraulic fluid from the derrick-mounted portion of the apparatus to a reservoir. The other two lines are a principle power source cable extending to the electrically operated valves, and a control cable which runs to the manually manipulatable wand or joy stick which is carried by the operator of the apparatus.

The boom and jaw subassembly which is detachably connected to the derrick bracket subassembly includes an elongated, extensible boom which can be hydraulically actuated to extend and retract telescoping sections of the boom with respect to each other. At the free outer end of the boom, a pair of jaws are pivotally supported on the boom and are hydraulically actuated in an opening or closing movement. The jaws carry roller elements which permit a casing or drill pipe section to be engaged without impairing or restricting the ability of the casing or the drill pipe section to swivel or turn about its axis, thus permitting the stabbing apparatus to remain engaged with the casing or drill pipe section as it is being threadedly connected to a section of drill pipe or casing suspended in the well bore from the rig floor. The extensible boom can be hydraulically actuated to pivot the boom about a horizontal axis at the end of the boom opposite the jaws, and to thereby cause the boom to be raised or lowered. The boom can also be hydraulically moved in a yawing motion from side-to-side.

An important object of the present invention is to provide a casing stabbing apparatus which is constructed to include at least three major interconnectable subassemblies which can be easily taken apart to facilitate transport, storage and operative mounting of the entire apparatus at a selected location in a drilling derrick and above the drilling floor of the derrick.

A further object of the invention is to provide a casing stabbing apparatus which can easily handle very large diameter casing up to, and including, thirty-six inch diameter casing, and which, when in use, does not impair or prevent the casing engaged by the stabbing apparatus from spinning or rotating about its casing section engage may be caused to spin on the crown block and elevators from which it is suspended, or may, by necessity, be spun up to threadedly engage the threaded lower end of the casing section with the internally threaded upper end of a casing section suspended on slips at the rotary table on the well floor.

A further object of the invention is to provide a large diameter casing stabbing apparatus which is relatively light in weight (as compared to many such devices which have been previously proposed), yet which is mechanically very strong and capable of engaging and selectively shifting the largest and heaviest casing sections, including some which have a weight of as much as three hundred pounds per running foot, as such are now used in the drilling of various oil, gas and geothermal wells.

A further object of the invention is to provide a casing stabbing apparatus which includes an extendable boom which carries jaws at one end for engaging the casing, and which is hydraulically movable in an up-and-down pivoting motion or in a side-to-side motion, or both such motions simultaneously, and which can be mounted in the derrick so that the entire apparatus can be located toward one corner of the derrick with the boom extending at a selected angle with respect to the portion of the apparatus by which it is mounted on the derrick.

Another important object of the invention is to provide a casing stabbing apparatus which can be relatively quickly and easily mounted upon the side of the derrick at a substantial height above the rig floor, and then can be operated very efficiently and accurately by remote control by an operator who carries a single, hand manipulatable wand or joy stick, and can move about the rig floor so as to sight in from several different angles, the casing section being maneuvered by the casing stabbing apparatus.

Additional objects and advantages of the invention will become apparant as the following detailed description of the invention is read in conjunction with the accompanying drawings which illustrate a preferred embodiment of the invention.

BRIEF DESCRIPTION OF THE DRAWINGS

FIG. 3 is a side elevation view of the casing stabbing apparatus, illustrating in dashed lines, an I-beam constituting a structural member of a derrick in which the casing stabbing apparatus is mounted, and also illustrating in dashed lines, a section of casing engaged by the casing stabbing apparatus.

DETAILED DESCRIPTION OF A PREFERRED EMBODIMENT OF THE INVENTION

Figure 1:
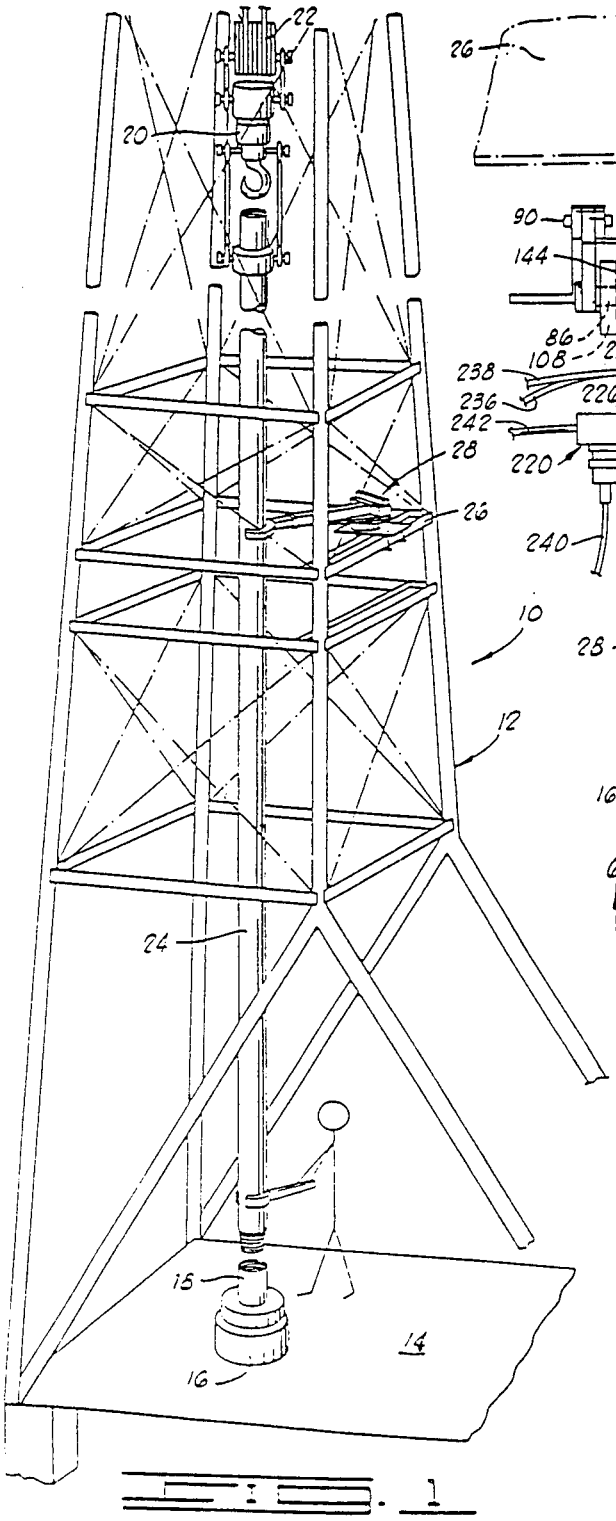
FIG. 1 is a perspective view, with parts broken away, showing a drilling rig platform with a derrick extending thereover, and with the present invention mounted in the derrick and in use for engaging a section of casing suspended from a crown block at the top of the derrick.

Referring initially to FIG. 1 of the drawings, shown therein is an oil well drilling rig 10 which, in that portion of the rig illustrated, includes a vertically extending derrick 12 and a rig floor or drilling platform 14. A rotary table 16 positioned on the rig floor 14 is used for supporting, by means of suitable slips (not shown), an elongated section of casing 18 which projects downwardly from the rig floor into the well bore.

In running a string of casing into a well, it is necessary to serially interconnect sections of the casing at a point of joinder at the rig floor, and to this end each succeeding section of casing to be attached to the section therebelow is suspended from a swivel 20 which is raised and lowered from a crown block 22 mounted at the top of the derrick 12. In FIG. 1, such a casing section 24 which is about to be threadedly connected to the section 18 therebelow is illustrated as suspended from the crown block 22. As is typical of the construction of a derrick, the derrick includes cross members 26 which are I-beams.

Figure 2:
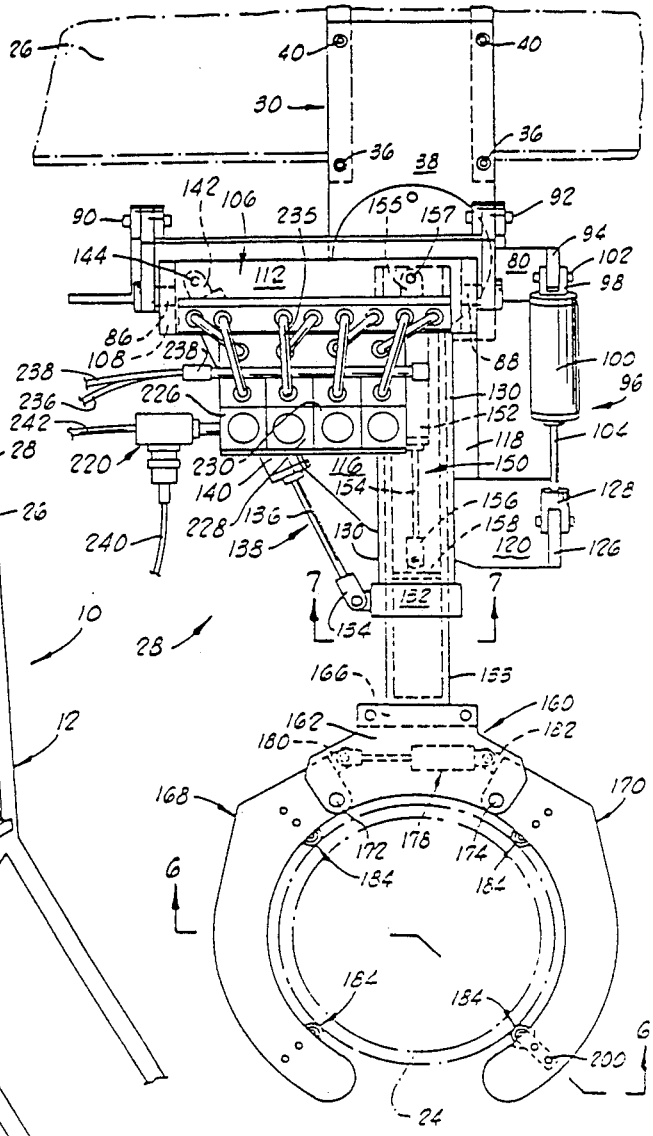
FIG. 2 is a plan view of the casing stabbing apparatus of the invention. An I-beam cross member of the derrick is illustrated in dashed lines and a remote control panel subassembly is shown as it appears when viewed from above.

A principal purpose and usage of the present invention is to stab or engage a median portion of a suspended section of large diameter casing with the casing stabbing apparatus of the invention. The stabbing apparatus is thereafter used to swing or move the casing section so as to more precisely align the end of the suspended casing section over the section of casing hung by slips in the rotary table, thereby permitting the casing sections to be threadedly engaged without cross threading. The casing stabbing apparatus of the present invention which is provided for this purpose is denominated generally by reference numeral 28. As illustrated in FIGS. 1-3, the casing stabbing apparatus 28 is mounted in the derrick 12 by bolting the apparatus to one of the I-beam cross members 26.

The casing stabbing apparatus 28 includes certain elongated control lines which will be hereinafter explained. These control lines extend to the rig floor from the principle portion of the stabbing apparatus mounted on a cross member 26 of the derrick 12. The apparatus 28 also includes a portable hand control or hand manipulatable wand 29 which can be carried by an operator of the apparatus as he walks about the rig floor 14 in a manner and for a purpose hereinafter described.

The casing stabbing apparatus 28 is illustrted in detail in FIGS. 2–7, and includes a derrick bracket subassembly, designated generally by reference numeral 30, and employed for mounting the apparatus on a cross member 26. The derrick bracket subassembly 30 includes a pair of horizontally extending bracket plates 32 and 34 (see FIG. 3) which are interconnected by a plurality of bolts 36. The bolts 36, in interconnecting the bracket plates 32 and 34, lock the bracket plates on the I-beam cross member 26. Two of the bolts 36 also extend upwardly through a base plate 38. Additional bolts 40 further secure the base plate 38 to the upper side of the upper bracket plate 32, as shown in FIGS. 2 and 3.

The base plate 38 is cantilevered inwardly of the derrick 12, and carries at one side of the base plate, a trunnion pedestal 42. The trunnion pedestal 42 projects vertically from the base plate 38 and has a lower trunnion plate 44 secured to its upper side. Pivotally supported on the lower trunnion plate 44 for pivotation about a centrally located pivot pin (not shown) is an upper trunnion plate 46. In the use of the casing stabbing apparatus, the upper trunnion plate 46 is generally pinned to the lower trunnion plate 44 by means of a locking pin 48. The locking pin 48 can be extended through selected ones of pairs of aligned apertures (not shown) in the upper and lower trunnion plates so as to permit the upper trunnion plate to be swiveled through approximately one hundred eighty degrees and selectively locked in a .chosen position of angulation with respect to the I-beam cross member 26 to which the derrick bracket assembly 30 is secured.

Figure 5:
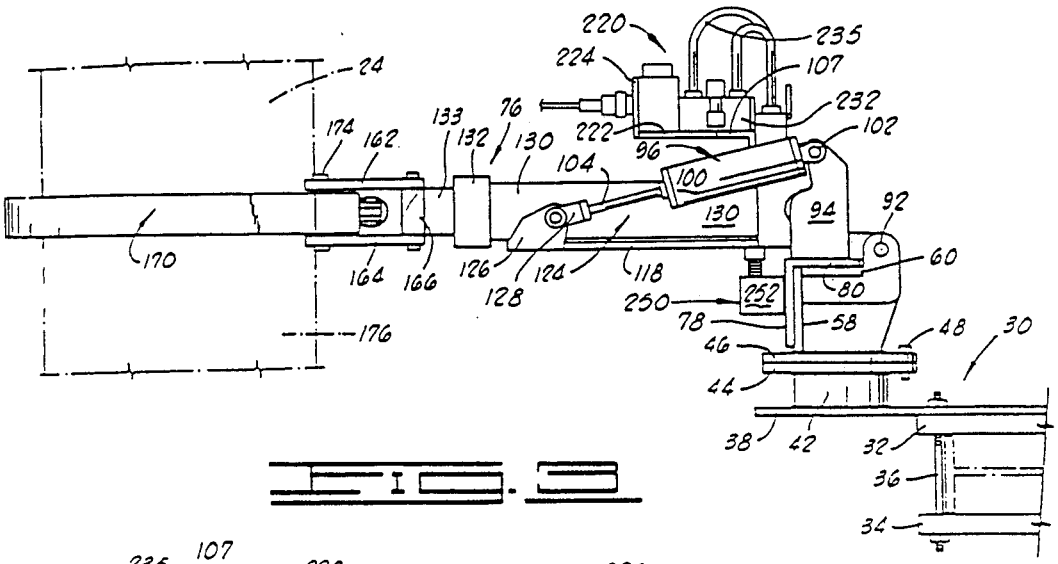
FIG. 5 is a rear elevation view of the casing stabbing apparatus as it appears when viewed from an angle displaced ninety degrees from the angle of view depicted in FIG. 4.

Secured to the upper side of the upper trunnion plate 44 is a vertically extending support plate 58. At its opposite ends, the vertically extending support plate 58 carries a pair of apertured ear portions 59 and 61 (as shown in FIG. 5) which facilitate the lifting and movement of the casing stabbing apparatus for raising and lowering parts of it in the derrick. A horizontally extending support plate 60 is secured along the upper edge of the vertically extending support plate 58, and is further supported by a pair of gusset or diagonal plates 62 and 64 which are each welded along one vertical edge to the vertically extending support plate 58, and along a horizontal upper edge to the horizontally extending support plate 60.

The derrick bracket subassembly 30 is mounted so that the base plate 38 of this subassembly projects toward the inner side of the derrick as illustrated in FIGS. 1 and 2. The best position for mounting of the derrick bracket subassembly 30 will frequently be offset from direct lateral alignment with the centerline of the casing section 24, and such preferred mounting position is illustrated in FIG. 1 where the apparatus is shown near the corner of the derrick.

At one end of the horizontally extending support plate 60, an L-shaped clevis plate 66 has its upper edge secured to the lower side of the horizontally extending support plate, and includes a vertically extending edge secured by welding or other suitable means to the rear side of the vertically extending support plate 58. Extending parallel to, and paired with, this clevis plate 66 is a second clevis plate 68 similarly secured to the underside of the horizontally extending support plate 60 and to the rear side of the vertically extending support plate 58. At the opposite end of the horizontally extending support plate 60, a similar pair of clevis plates 70 and 72 are secured between the horizontally and vertically extending support plates. The pairs of clevis plates 66–68 and 70–72 provide points of pivotal connection to the derrick bracket subassembly 30 of a boom and jaw subassembly designated generally by reference numeral 76.

The boom and jaw subassembly 76 includes a vertically extending face plate 78 which is dimensioned and adapted to bear flatly against the forward side of the vertically extending support plate 58 which forms a portion of the derrick bracket subassembly 30. The boom and jaw subassembly 76 further includes an upper, horizontally extending plate 80 which is joined at one edge to the upper edge of the facing plate 78 and extends normal thereto so as to flatly abut and ovelie the horizontally extending support plate 60.

Figure 4:
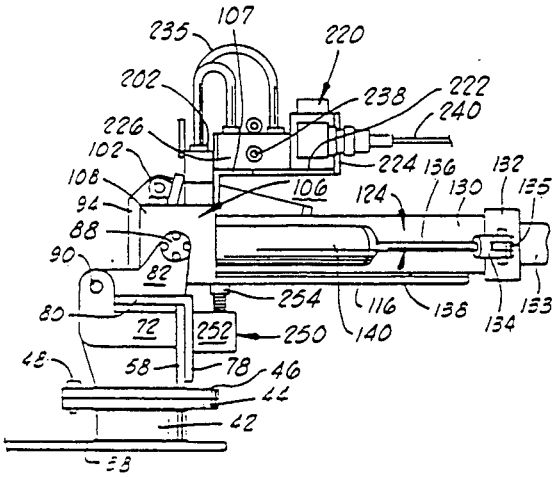
FIG. 4 is a side elevation view of a portion of the casing stabbing apparatus, and illustrates this portion of the casing stabbing apparatus as it appears when viewed from the opposite side thereof as from that side which is shown in FIG. 3.
Figure 5:
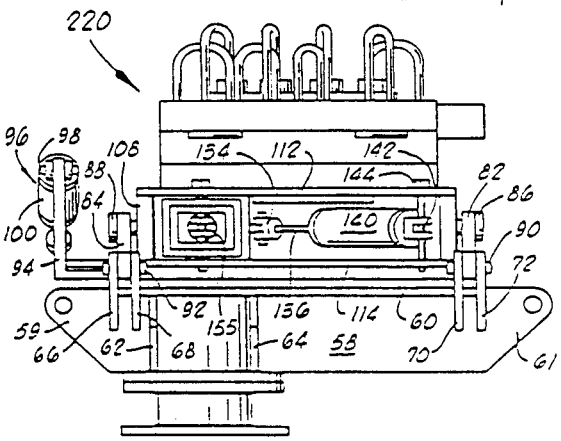

In order to permit the boom and jaw subassembly 76 to be operatively connected to the derrick bracket subassembly 30, a pair of horizontally spaced journal and clevis plates 82 and 84 are secured to the upper side of the upper plate 80 and project vertically upward therefrom as shown in FIGS. 4 and 5. The upper end of each of the clevis plates 82 and 84 is apertured to facilitate extension therethrough of a journal shaft. These journal shafts are illustrated best in FIGS. 2, 4 and 5 and are denominated by reference numerals 86 and 88. Each of the journal and clevis plates 82 and 84 further carry an ear portion, and these ear portions project rearwardly to a location between the pairs of clevis plates 66–68 and 70–72 carried on the derrick bracket subassembly 30. The journal and clevis plates 82 and 84 are pivotally pinned at this location to the pairs of clevis plates 66 and 68 and 70 and 72 by means of pivot pins 90 and 92 as shown in FIGS. 3–5.

At its end opposite the end which carries the clevis plate 82, the upper horizontally extending plate 80 has secured to the upper side thereof, an upwardly projecting clevis plate 94. The clevis plate 94 functions as an anchor plate or point of mounting for a hydraulic piston and cylinder subassembly 96 as depicted in FIGS. 3 and 5. The hydraulic piston and cylinder subassembly 96 includes a clevis bracket 98 carried on one end of a hydraulic cylinder 100. The clevis bracket 98 is pinned to the clevis plate 94 by means of a suitable pin 102. The piston and cylinder subassembly 96 further includes a piston rod 104 which can be extended and retracted with respect to the cylinder 100. The movement of the piston rod 104 is controlled from a remote control panel subassembly, hereinafter explained, through hydraulic lines or conduits to the cylinder 100 and to other hydraulic cylinders used in the casing stabbing apparatus of the invention, and hereinafter described.

The journal shafts 86 and 88 which project through apertures in the upper portions of the clevis plates 82 and 84 are used to pivotally support a boom housing subassembly, designated generally by reference numeral 106, for pivotation about a horizontal axis. The boom housing subassembly 106 includes a pair of end plates 108 and 110 to which the journal shafts 86 and 88 are secured. A pair of parallel upper and lower housing plates 112 and 114, respectively, are also a portion of the boom housing subassembly 106, and extend between, and interconnect the end plates 108 and 110. The upper and lower housing plates 112 and 114, together with the end plates 108 and 110, thus form a hollow, open sided rectangular parallelepiped. This open box, as thus formed, is pivotable about a horizontal axis which extends coincident with the axes of the two aligned journal shafts 86 and 88.

Projecting horizontally outwardly from the lower housing plate 114, and in coplanar alignment therewith, is a diagonal boom plate 116. The diagonal boom plate 116 is joined to a forwardly extending boom plate 118 which also projects horizontally from the lower housing plate 114, and is in coplanar alignment with the lower housing plate and with the diagonal boom plate 116. A lateral lift plate 120 is secured to both the diagonal boom plate 116 and the forwardly extending boom plate 118 and extends to one side of the forwardly extending boom plate 118 so as to be horizontally offset from an elongated extensible boom, designated generally by reference numeral 124, and forming a portion of the boom and jaw subassembly 76.

A lifting ear 126 projects vertically from one edge of the lift plate 120, as shown in FIGS. 2 and 3, and serves as a point of connection to a clevis 128 carried at one end of the piston rod 104 forming a part of the hydraulic piston and cylinder subassembly 96. It will be perceived that when the piston rod 104 is retracted into the cylinder 100, the effect of the retraction is to elevate the diagonal boom plate 115 and the forwardly extending boom plate 118. This in turn elevates the extensible boom 124 by pivoting the boom about a horizontal pivotal axis disposed within the boom housing subassembly 106.

The extensible boom 124 includes a stationary sleeve 130 which is of rectangular cross-sectional configuration and extends outwardly from the boom housing subassembly 106. One end of the stationary sleeve 130 is rigidly and firmly secured in the boom housing subassembly and the other end is surrounded by a reinforcing collar 132. The reinforcing collar 132 prevents splitting of the stationary sleeve 130 as an internal extendable sleeve 133 slidably disposed in the stationary sleeve is telescopingly reciprocated inwardly and outwardly in the stationary sleeve as hereinafter described.

The reinforcing collar 132 has an eye 135 at one side thereof which permits a clevis 134 carried at one end of a piston rod 136 to be pivotally connected thereto. The piston rod 136 forms a part of a yaw control piston and cylinder subassembly designated generally by reference numeral 138. The yaw control piston and cylinder subassembly 138 further includes a hydraulic cylinder 140 which carries a clevis 142 at its base end. The clevis 142 at the base end of the cylinder 140 is pivotally pinned within the boom housing subassembly 106 by a pivot pin 144 which projects through the upper housing plate 112, through the clevis 142 and into the lower housing plate 114. It will be perceived from this description that the cylinder 140 and the piston rod 136 which is extensible therefrom can be pivoted about a vertical axis constituted by the pivot pin 144. This action is used for causing the boom 124 to undergo a yawing or swiveling movement from side-to-side about a vertical axis.

The boom 124 is variable in length, and to this end, the telescoping extendable internal sleeve 133 is provided. The sleeve 133 is of rectangular cross-sectional configuration, and is dimensioned to slidingly telescope within the stationary sleeve 130 so that the extensible sleeve can be extended out of, and retracted into, the stationary sleeve 130. To effect the extension and retraction of the inner sleeve 133, a boom extending piston and cylinder subassembly designated generally by reference numeral 150 is provided. The boom extending piston and cylinder subassembly 150 includes a hydraulic cylinder 152 having a piston rod 154 extensible therefrom upon actuation. The cylinder 152 carries a clevis 155 (See FIGS. 2 and 5) which is pivotally pinned within the boom housing subassembly 106 to facilitate horizontal yawing movement of the boom 124 which is also pinned in the subassembly 106 by the pin 157. The piston rod 154 has a clevis 156 connected through a connection plate 158 to the extensible sleeve 133 so that, when the piston rod 154 is extended from the cylinder 152 the extensible sleeve 133 will be extended outwardly from the stationary sleeve 130 to increase the length of the extensible boom 124.

The sleeve 133 has secured to the free outer end thereof, a casing jaw supporting bracket designated generally by reference numeral 160. The casing jaw supporting bracket 160 includes an upper plate 162 and a lower plate 164 which are connected to the opposite sides of a transverse bar 166 which extends between the rear edges of the upper and lower plates (see FIGS. 2 and 6).

The function of the casing jaw supporting bracket 160 is to pivotally support and carry a pair of pivotally mounted arcuate casing jaws, designated generally by reference numerals 168 and 170, at the outer end of the elongated extensible boom 124. The casing jaws 168 and 170 are each mounted in the casing jaw supporting bracket 160 by means of pivot bolts 172 and 174, respectively. Each of the pivot bolts 172 and 174 is pinned through a corner of the respective casing jaw 168 and 170 so that each of the arcuate casing jaws can be caused to pivotally converge upon and grip a section of large diameter casing, such as that illustrated in dashed lines n FIGS. 2 and 3, and there denominated by reference numeral 24. Each of the arcuate casing jaws 168 and 170 is also connected to a piston and cylinder subassembly 178 which functions to interconnect the casing jaws and to cause them to be pivoted toward and away from each other as the piston rod of the assembly 178 is extended and retracted. As shown in FIG. 2, the piston and cylinder subassembly 178 is connected at opposite ends to opposed ears 180 and 182 located at the corner of one of the ends of each of the respective arcuate casing jaws 168 and 170, and the jaws are mounted for pivotation about the respective pivot bolts 172 and 174.

Figure 6:
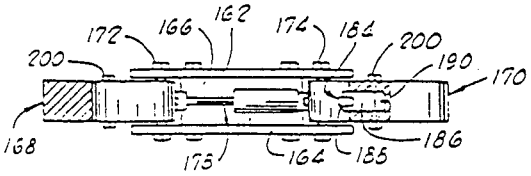
FIG. 6 is a sectional view taken along line 6—6 of FIG. 2, and illustrating portions of the casing gripping jaws forming a part of the casing stabbing apparatus of the invention.
Figure 7:
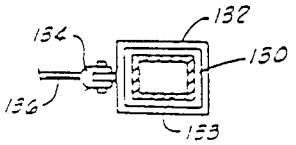
FIG. 7 is a sectional view taken along line 7—7 of FIG. 2.
Figure 8:
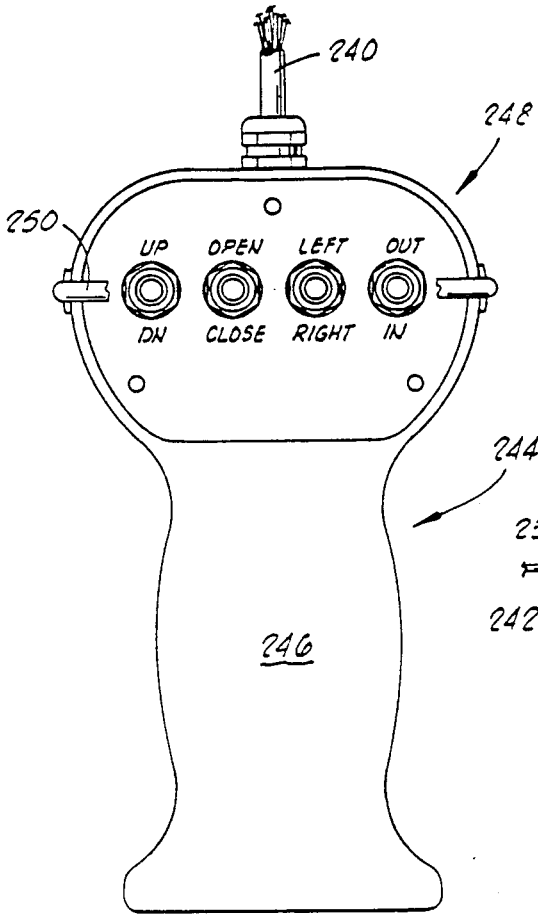
FIG. 8 is a top plan view of the hand manipulatable remote control wand or joy stick with a portion of a guard bracket which protects the thumb movable toggle switches taken away to show the four toggle switches carried on the wand.
Figure 9:
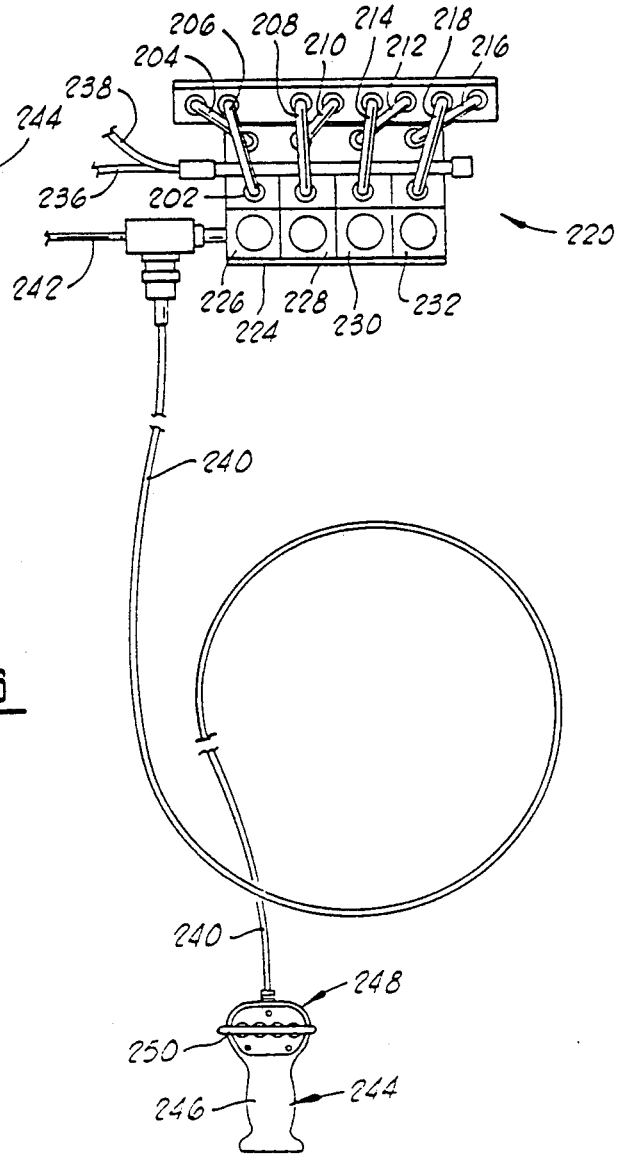
FIG. 9 is a diagrammatic view of the remote control panel subassembly associated hand manipulatable wand, power source and hydraulic source.

Each of the arcuate casing jaws 168 and 170 is a thick metallic plate having an inner peripheral surface cut on the circumference of a circle, and each carries four movable roller elements. The roller elements are identically constructed and each is designated generally by reference numeral 184 (see FIGS. 4 and 6). Each of the roller elements 184 includes, as shown in FIG. 6, a short bar 186 which has its radially inner end slotted to rotatably receive a small roller 188 pinned in the bar. Each of the bars 186 is dimensioned to slide radially inwardly and outwardly in an accommodating slot 190. Each slot 190 is cut radially into the respective casing jaw, and is dimensioned to closely and slidably receive one of the bars. Each bar 186 has at least two spaced pin holes formed downwardly therethrough intermediate its length. The respective casing jaw also includes two spaced pin holes formed through the casing jaw in alignment with the slot 190. The pin holes are dimensioned to receive a positioning pin 200 which can be inserted through aligned hole pairs when the respective bars are in their radially innermost positions, or can be inserted through other aligned hole pairs to lock the respective bars 186 in position at a time when the bars are moved to their radially outermost positions. In this way, by the use of the positioning pins 200 associated with each of the slots 190 and bars 186 of the movable roller elements 184, the roller elements may be moved radially inwardly or radially outwardly so that the arcuate casing jaws can be adapted in this fashion for engaging a very large casing section having an outside diameter of about twenty-four inches, or a smaller casing section having an outside diameter of sixteen inches.

It should be pointed out that the hydraulic power fluid conduits which extend to the cylinder of the piston and cylinder subassembly 178, to the cylinder 140 of the yawing piston and cylinder subassembly 138, to the cylinder 152 of the boom extending piston and cylinder subassembly 150 and to the boom lifting cylinder 100 all extend in the projected positions to points above the upper housing plate 112 where quick disconnect fittings are provided to permit quick connection to be made with flexible hydraulic power fluid conduits 204–218 (eight in all) extending from this location to the valves forming a part of a remote control panel subassembly 220.

The remote control assembly 220 is mounted above the upper housing plate 112 of the boom housing subassembly 106 by means of angle mounting braces 107. This relationship is illustrated in FIGS. 2–5 of the drawings. Mounting of the remote control panel subassembly 220 upon the plate 112 can also be by any other suitable means such as bolting, rivoting or screwing or the like, but it preferably is detachably connected to the boom housing subassembly so that it can be removed from the assembly and lowered separately from the remainder of the apparatus. This facilitates any repairs to the valve bank forming a part of the remote control panel subassembly 220 that may be required any time. Moreover, it may be desirable to replace the remote control panel subassembly 220 with a subassembly which includes a fewer number of valves or a greater number of valves, depending upon the controls which are desired.

The remote control panel subassembly 220 includes a base plate 222 which extends horizontally and flatly abuts the upper housing plate 212 of the boom housing subassembly 106. It also includes a vertically extending plate 224 secured to the forward edge of the plate 222.

The control panel subassembly 220 further includes a bank of four valves 226, 228, 230 and 232 which are electrically controlled valves shiftable to provide hydraulic power fluid to a selected one or more of the hydraulic cylinders 100, 140, 152 or 178, as may be required during the operation of the apparatus for stabbing and positioning a section of casing.

A hydraulic power fluid supply conduit 236 extends from one end of the valve bank downwardly to the drilling platform and is there connected to a suitable hydraulic pump (not shown) for the purpose of supplying the hydraulic power fluid necessary to operate the several piston cylinder assemblies hereinbefore described. A return conduit 238 also projects from the end of the valve bank downwardly to the drilling platform to allow exhausted hydraulic fluid to return to a reservoir or sump in the course of recirculation in a conventional fashion.

In order to shift the valves 226–232, electrical solenoids are included in the remote control panel subassembly 220, and are actuated by power signals delivered via conductors extended through a control cable 240 which extends from the drilling platform upwardly to the remote control panel subassembly 220. The control cable can be plugged into the control panel subassembly 220 by the use of a suitable jack. In similar fashion, a power cable 242 extends downwardly to the drilling platform where it is connected to an on/off switch (not shown) and functions to supply power to the remote control panel subassembly 220 for operating the several solenoids used to control the status of the valves 226–232.

When assembling the casing stabbing apparatus in the derrick, it is frequently desirable to raise and lower the remote control panel subassembly 220 separately. This reduces the weight which must be raised and lowered at any one time, and also permits better protection for the sensitive instrumentation and valving in the remote control panel subassembly. Such separate movement can be achieved by detaching the base plate 222 and its associated vertically extending plate 224 from the boom housing subassembly 106, after the hydraulic power fluid supply conduit 236 and hydraulic return conduit 238 have been detached from the remote control panel subassembly 220. The control cable 240 and power cable 242 are also detached from their respective jacks, and are lowered to the drilling platform prior to detachment of the base plate 222 from the upper housing plate 112 of the boom housing subassembly 106.

A hand manipulatable wand or portable hand control device designated generally by reference numeral 244 is connected to the lower end of the control cable 240.

The hand control wand or joy stick 244 includes a handle 246 of the pistol grip-type which can be gripped in the palm of the hand and a control head 248 which has a flat surface having a plurality of toggle switch levers projecting upwardly therefrom. The toggle switch levers are illustrated in the neutral or central position. These toggle switch levers are protected from inadvertent damaging impact in the event that the portable hand control wand or joy stick 244 is dropped. This protection is afforded by a rigid protective bar 250 which projects across the face of the control head and protects the toggle switch levers. The toggle switches are four in number corresponding to the four hydraulic cylinders used in the four piston and cylinder subassemblies which are characteristic of the preferred embodiment of the casing stabbing apparatus of the invention. Thus, the toggle switch at the left side of the control head 248 is the switch for causing the cylinder 100 to be actuated to either lift the boom upwardly or lower the boom at a time when it is desirable to move the boom to a position adjacent the side of the derrick to get it out of the way, or to lower it into the operating position.

The next switch, which is second from the left, controls the opening and closing of the jaws 168 and 170 which function to engage the section of casing when the casing section is to be stabbed and aligned in the manner hereinafter described. The third of the toggle switches controls the hydraulic fluid to and from the cylinder 140 to extend or retract the piston rod 136. This controls the yawing movement of the extensible boom. Finally, the toggle switch on the right side of the bank controls the extension and retraction of the boom itself by directing hydraulic fluid to and from the cylinder 152. When these toggle switches are shifted one way or the other, an electrical signal is sent to one of the solenoids which control the status of the electrically controlled valves 226–232. This will then in turn cause one or more of the hydraulic cylinders described to be actuated to cause some type of manipulation of the boom or the casing engaging jaws carried at one end thereof.

As a final feature of the invention, a safety control limit switch subassembly is provided and is designated generally by reference numeral 250. The limit switch subassembly 250 includes an on/off contact switch (not shown) located within a housing 252. A switch control screw 254 is susceptible to adjustment in its relation to the plate 116 which is positioned beneath the extensible boom so that as the boom is elevated or lowered by means of the cylinder 100, the limit switch 250 will be actuated to open an electrical circuit which controls the direction of movement of hydraulic cylinder 100 at a time when the boom has achieved a perfectly horizontal level. It is desired, from the standpoint of preventing the boom from being pivoted downwardly to a position at which it extends at an acute angle below a horizontal plane, to calibrate the boom each time before operation and make certain that the limit switch 250 is operative to prevent pivotation of the boom downwardly below a horizontal plane.

OPERATION

In utilizing the casing stabbing apparatus 28 of the invention, the apparatus will be mounted at some intermediate location on the derrick 12, such as on the cross member 26 as illustrated in FIG. 1. To mount the casing stabbing apparatus 28 in this manner, the bolts 36 are extended on opposite sides of the I-beam and through the upper bracket plate 32 and lower bracket plate 34 of the derrick bracket subassembly 30 as shown in FIGS. 2 and 3.

When the derrick bracket subassembly 30 has been bolted to the cross member 26 of the derrick 12 in the manner described, the boom and jaw subassembly 76 is then swiveled or pivoted to a position where the extensible boom 124 projects toward the casing section 24. This is accomplished by rotating the upper trunnion plate 46 on the lower trunnion plate 44 until approximate alignment of the extensible boom 124 with the casing section 24 has been attained. At this point, the upper trunnion plate 46 is pinned to the lower trunnion plate 44 by the us of the locking pin 48 extended through registering apertures in the two trunnion plates.

In order to assure that the extensible boom extends perfectly horizontally at a time when it is lowered to its operative position, a mercury level or other suitable means is used to aid in adjusting the switch control screw 254 of the limit switch 250 so that the switch will be actuated to interrupt hydraulic fluid flow to the cylinder 100 at a time when the boom extends horizontally. While the boom can extend slightly upwardly with respect to the horizontal (at an angle of between zero and five degrees) and often does so to advantage, it is undesirable for the boom to extend downwardly at an angle below the horizontal because where such is the case, it will, in most instances result in the boom extending at an angle to the axis of the casing section which is undesirably larger than ninety degrees and the jaws will not clamp around the casing section with a uniform fit. This can result in damage to the jaws and causes the casing to be handled less effectively.

With the casing stabbing apparatus 28 thus mounted and positioned, the various hydraulic piston and cylinder subassemblies are then used to engage a casing section 24 hung from the swivel 20 which in turn is suspended from the crown block 22. Prior to engaging the casing section, however, the movable roller elements 184 carried on the two arcuate casing jaws 168 and 170 have been adjusted radially inwardly or radially outwardly, according to whether the casing section to be engaged is a very large diameter casing section, or a relatively smaller diameter casing section. This is accomplished by initially manually removing the positioning pins 200 to permit the bars 186 of each of the movable roller elements 184 to be moved radially inwardly or outwardly to the desired position. When this has been accomplished, the positioning pins are reinserted to lock the movable roller elements 184 in the proper position for casing engagement.

After this, the piston and cylinder subassembly 178 is actuated to retract the piston rod thereof and thereby cause the arcuate casing jaws 168 and 170 to be opened apart from each other by pivotation of each of the jaws about the respective pivot bolts 172 and 174. With the arcuate casing jaws 168 and 170 thus opened apart from each other, the jaws are then moved to a position where they surround the suspended casing section 24. This is accomplished by means of the piston and cylinder subassembly 138 and the piston and cylinder subassembly 150.

By extending the piston rod of the boom extending piston and cylinder subassembly 150, the extensible sleeve 133 is caused to slide outwardly from the stationary sleeve 130 to extend the length of the boom, and thus cause the arcuate casing jaws 168 and 170 to move outwardly until the desired position of the jaws around and on opposite sides of the casing section 24 has been achieved. This is aided by extension or retraction of the piston rod 136 of the yawing piston and cylinder subassembly 138 to cause the extensible boom to pivot about the vertical axis of pivotation which is coincident with the pivot pin 157. The jaws 168 and 170 are thereby caused to swing laterally in either direction as may be necessary to align the jaws with the casing section.

When the casing jaws 168 and 170 have been brought to a position on opposite sides of the casing section 24, the piston rod of the piston and cylinder subassembly 178 is extended. This movement causes the jaws to pivot inwardly toward each other until the rollers 188 of the several movable roller elements 184 engage the casing at locations which are spaced about ninety degrees from each other about the periphery of the casing. It should be noted that when the casing is engaged in this fashion, the casing can still spin about its axis because the rollers 188 carried rotatably at the radially inner ends of the bars 286 can undergo rotation to accommodate such casing spinning movement.

When the casing section 24 has been thus engaged by the jaws 168 and 170, the operator of the casing stabbing apparatus 28, by appropriate manipulation of the toggle valves carried on the portable hand control wand or joy stick 244 can cause the section of casing to be moved in small increments in any direction. Thus, by remote control by an operator located on the rig floor 14, the heavy section of large diameter casing 24 can be brought to a position directly above the section of casing 18 held by slips in the rotary table 16. Then, as the crown block is very slowly lowered, the five threads at the lower end of the suspended casing section 24 can be made to precisely line up with, and engage, the threads in the casing section 18 in the rotary table. The suspended casing section 24 can be spun up to tighten the threads into engagement with each other and complete the joint without damage to the threads, and with a minimum amount of manual manipulation required by personnel on the rig floor. Importantly, the dangerous procedure of having a crew member manually manipulating the heavy casing section from a position high in the derrick is totally eliminated. With the present hydraulically powered casing stabbing apparatus to be in the derrick.

When the casing section has been spun up to form the joint with the casing section 18, the casing jaws 168 and 170 of the casing stabbing apparatus are opened apart from each other by retraction of the piston rod of the piston and cylinder subassembly 178. Opening the jaws permits them to be withdrawn from around the casing by retracting the piston rod of the boom extending piston and cylinder subassembly 150.

In many instances, it will be desired, at times when the casing stabbing apparatus 28 is not in use, to move the boom 124 to a position where it does not project out over the rig floor 14, and does not interfere with other pipe or tubular member handling operations. To accomplish this, the piston rod 104 of the hydraulic piston and cylinder subassembly 96 is retracted so that the boom 124 is pulled upwardly. The boom is permitted to pivot in this upward direction by pivotation of the boom housing subassembly 106 on the journal shafts 86 and 88. Raising of the extendable boom in this fashion is effected by the upward lifting of the diagonal boom plate 116, the forwardly extending boom plate 118 and the lift plate 120 to which the piston rod 104 is connected through the clevis 128.

When it is desired to again use the casing stabbing apparatus 28, the piston rod 104 of the hydraulic piston and cylinder subassembly 96 is extended to lower the diagonal boom plate 116, forwardly extending boom plate 118 and lift plate 120 to which the piston rod 104 is connected through the clevis 128. When it is desired to again use the casing stabbing apparatus 28, the piston rod 104 of the hydraulic piston and cylinder subassembly 96 is extended to lower the diagonal boom plate 116, forwardly extending boom plate 118 and lift plate 120, and to thereby lower the extensible boom 124 to its horizontally extending position.

It should be pointed out that the casing stabbing apparatus of the present invention is easily transported, assembled and used by reason of the construction of the casing stabbing apparatus in three major subassemblies which can be easily disconnected from each other to facilitate ease of transport and storage of the parts of the apparatus. Thus, the remote control panel subassembly 220 can be quickly disconnected from the boom and jaw subassembly and lowered to the rig floor. The boom and jaw subassembly can be quickly disconnected from the derrick bracket subassembly 30 by removing the pivot pins 90 and 92 to permit the clevis plate pairs 66–68 and 70–72 to be disconnected from the clevis plates 82 and 84 carried on the upper horizontally extending plate 80 of the boom and jaw subassembly. The apertured end portions 59 and 61 of the vertically extending support plate 58 of the derrick bracket subassembly 30 provide locations where cables or hoisting slings can be quickly attached to the derrick bracket subassembly 30 to permit it to be hoisted into the derrick and secured to one of the cross beams 26 in the manner described.

The casing stabbing apparatus of the invention is particularly efficient and effective in use because it eliminates the need to have one and frequently two persons in the rig who try to manipulate the casing manually, or even to control the hydraulically controlled apparatus of this invention. With the present invention, this control can be entirely from a remote location, such as the rig floor. By the use of the remote control panel subassembly 220 in conjunction with the hand manipulated wand or joy stick 244, the operator of the apparatus can walk about the rig floor and sight from several angles, the direction of lean, if any, of the suspended elongated casing section. It is thus possible to eliminate paralax in viewing the casing section, and to be especially accurate in aligning the axis of the suspended casing section in a vertical line directly above the axis of the casing section into which it is to be stabbed and threadedly connected. The operator of the apparatus can actually operate the apparatus with a single hand, leaving the other hand free to assist the operator in moving about the drilling platform and in giving hand signals, if necessary, to the operator of the crown block and elevators in terms of raising or lowering the casing section which is engaged by the casing stabbing apparatus.

From the foregoing description of the invention, it will be apparent that the casing stabbing apparatus of the invention provides a compact, relatively simply constructed, mechanically rugged and highly useful apparatus for engaging and guiding a suspended, large diameter casing section as it is lowered for threaded engagement with a casing section retained in the rotary table at the rig floor. The apparatus can be remotely operated from the rig floor. The apparatus is particularly well suited for engaging very large diameter casing weighing as much as three hundred pounds per foot, and constituting a safety hazard to operating personnel who attempt to manually manipulate the suspended casing section to achieve the necessary alignment.

Although the casing stabbing apparatus has been depicted in a particular form constituting a preferred embodiment, it will be understood that various changes and modifications in the illustrated and described structure can be effected without departure from the basic principles which underlie the invention. Changes and innovations of this type are deemed to be circumscribed by the spirit and scope of the invention except as such spirit and scope may be necessarily limited by the appended claims, or reasonable equivalents thereof.

What is claimed is:

1. A casing stabbing apparatus which comprises:

a derrick bracket subassembly adapted for attachment to a structural member of a well derrick;

a boom and jaw subassembly detachably connected to said derrick bracket subassembly and comprising:

an elongated, variable length boom having a first end pivotally connected to said derrick bracket subassembly, and having a second end;

a pair of casing-engaging jaws pivotally mounted on the second end of said boom opposite its first end;

means for selectively changing the length of said boom;

a yawing piston and cylinder subassembly extending at an acute angle to the longitudinal axis of the boom and connected to a medial portion of the boom for pivoting the boom from side-to-side;

radially adjustable roller means including a plurality of rollers carried on said jaws for selectively adjusting a diametric dimension defined by a circle drawn in contact with said rollers and inside said jaws to thereby facilitate stabbing casing sections of varying diametric sizes; and a piston and cylinder subassembly connected between said jaws for pivoting said jaws in a converging, or a diverging movement so as to bring the rollers carried on said jaws into engagement with a casing section;

a remote control assembly detachably connected to said boom and jaw subassembly, said remote control assembly including a plurality of electrically controlled hydraulic valves for selectively supplying hydraulic power fluid to said piston and cylinder subassemblies;

a portable hand control device remote from said hydraulic valves of the remote control assembly and having a plurality of switches thereon;

a control cable connected between the portable hand control device and the remote control assembly for transmitting control signals from the portable hand control device to the remote control assembly;

means for supplying electrical power to the remote control assembly;

means for supplying hydraulic power fluid to said electrically controlled hydraulic valves; and means for returning hydraulic power fluid from said piston and cylinder subassemblies as said electric controlled hydraulic valves are shifted.

2. A casing stabbing apparatus comprising:

an elongated, extensible boom;

a pair of arcuate jaws pivotally connected to one end of the boom and pivotally convergent with respect to each other for bringing the jaws into close proximity to a casing section, each of said jaws having a concave inner side;

a plurality of spaced roller elements mounted in each of said jaws on the concave inner side thereof and being radially adjustable with respect to the concave inner side of the respective jaw;

means for elevating the end of the boom carrying said jaws without elevating the opposite end of said boom;

means for laterally displacing the end of the boom carrying said jaws;

a boom housing subassembly pivotally receiving the end of said boom opposite its end to which said jaws are connected;

trunnion means detachably and pivotally connected to, and supporting, said boom housing subassembly, said trunnion means comprising:

plate means adapted for connection to a well derrick structural member for mounting the casing stabbing apparatus in a derrick positioned over a well bore into which the casing is to be lowered;

a horizontally extending upper trunnion plate rotatably secured to the upper side of said plate means; and means for selectively interlocking said upper trunnion plate to said plate means to fix the rotative orientation of said upper trunnion plate in relation to said plate means, and to the derrick to which it is attached;

support means secured to the upper side of said horizontally extending upper trunnion plate for movement therewith, and including horizontally spaced clevis plates; and means detachably and pivotally connecting said boom housing subassembly to said support plate means for pivotation of the boom housing subassembly about a horizontal axis of pivotation, said means detachably and pivotally connecting said boom housing subassembly to said support plate means comprising:

a pair of horizontally spaced second clevis plates each pivotally connected to one of said clevis plates on said support plate means secured to the upper side of said horizontally extending upper trunnion plate, and each further including a portion pivotally journaled to said boom housing subassembly.

3. A system for making up a vertically extending string of threadedly interconnected tubular sections, including large diameter casing, by serially threaded interconnection of said tubular sections in end-to-end vertically extending relation to each other, comprising:

means for supporting a tubular first section in a vertical orientation, with the upper end stationary and the lower portion in a well bore;

a derrick erected above said supporting means and having sides, an upper end and a rig floor at which said tubular section supporting means is located;

a traveling crown block supported in the upper end of said derrick and lowerable toward said tubular section supporting means and said rig floor for suspending a second section of tubular above the rig floor; and a tubular section stabbing and positioning means demountably connected to a side of the derrick at a location which facilitates engaging a medial portion of said second section of tubular, said tubular section stabbing and positioning means including:

a derrick bracket subassembly detachably connected to a side of said derrick; and a boom and jaw subassembly pivotally connected to said derrick bracket subassembly, said boom and jaw subassembly further including:

an elongated, extensible boom having a first end and having a second end pivotally connected to said detachably connected derrick bracket subassembly for pivotation about a vertical axis when said boom is yawed from side-to-side at a time when said boom extends substantially horizontally;

a yawing piston and cylinder subassembly connected to said boom and extending at an acute angle to the longitudinal axis of the boom for swinging said boom from side-to-side in pivotation about a pivotal axis which is substantially vertical at a time when said boom is substantially horizontal;

means for selectively extending and retracting the boom to lengthen and shorten the boom;

two, spaced arcuate jaws pivotally mounted on said first end of said boom for pivotation about substantially parallel axes as said jaws are swung in a converging movement for purposes of engaging a tubular section, each of said jaws having a concave inner side;

rollers mounted on the concave inner side of each of said arcuate jaws and facing each other across the space separating said jaws;

means for selectively varying the distance separating the rollers mounted on one jaw from the rollers mounted on the other jaw; and a boom raising piston and cylinder means for raising and lowering the first end of said boom by pivotation of said boom about a substantially horizontally extending axis and without interferring with the operation of said yawing piston and cylinder subassembly in swinging said boom from side-to-side; and hydraulic control means detachable mounted on said boom and jaw subassembly for controling the flow of hydraulic fluid to said piston and cylinder subassemblies.

4. A system for making up a vertically extending string of threadedly interconnected casing sections by serially threaded interconnection of casing sections in end-to-end vertically extending relation comprising:

a rig floor;

means suspending a first section of casing in a vertical orientation below the rig floor with the upper end stationary;

a derrick erected above said suspending means and having sides and an upper end spaced vertically above the rig floor at which said suspending means is located;

a traveling crown block supported in the upper end of the derrick and lowerable toward said suspending means and said rig floor for suspending a second section of casing above the rig floor and above said suspended first section of casing;

a casing section stabbing and positioning means demountably connected to a side of the derrick at a location facilitating engagement by said stabbing and positioning means of a medial portion of said second section of casing, said casing stabbing and positioning means including:

a derrick bracket subassembly detachably connected to a side of said derrick;

a boom and jaw subassembly detachably connected to said derrick bracket subassembly, and including:

an elongated, extensible boom having a first end pivotally connected to said derrick bracket subassembly for pivotation of the boom about a horizontal axis, and further having a second end at the opposite end of said boom from said first end;

a pair of casing-engaging jaws pivotally mounted on the second end of said boom, said jaws each having a generally concave inner side, and said two arcuate jaws being movably connected to said second end of said boom for pivotation about a pair of spaced, substantially parallel axes as said jaws are swung in a converging movement, or in a diverging movement; and means for selectively pivoting said boom about said horizontal axis to raise and lower the second end of said boom which carries said jaws, and to elevate said boom to a location where it extends in a generally vertical direction;

means for selectively varying the length of said boom comprising:

a boom extending piston and cylinder subassembly located adjacent the boom and connected to the boom for increasing and decreasing the length of the boom;

radially adjustable roller means carried on the concave inner side of said arcuate jaws for selectively adjusting the diametric dimension defined inside said jaws to thereby facilitate stabbing casing sections suspended from said traveling crown block despite variations in the diametric sizes of said casing sections; and a piston and cylinder subassembly connected between said jaws for pivoting said jaws in a converging movement, or in a diverging movement; and a remote control assembly detachably mounted on said boom housing subassembly, said remote control assembly including a plurality of electrically controlled hydraulic valves for selectively supplying hydraulic power fluid to said piston and cylinder subassemblies.

5. A system for making up a vertically extending string of interconnected casing sections as defined in claim 4 and further characterized as including a yawing piston and cylinder subassembly extending at an acute angle to the longitudinal axis of the boom and connected to a medial portion of the boom for pivoting the boom from side-to-side about an axis which, at a time when the boom extends horizontally, extends substantially vertically.

6. A system for making up a vertically extending string of interconnected casing sections comprising:

a rig floor;

means suspending a first section of casing in a vertical orientation below the rig floor with the upper end stationary;

a derrick erected above said suspending means and having sides and an upper end spaced vertically above the rig floor at which said suspending means is located;

a traveling crown block supported in the upper end of the derrick and lowerable toward said suspending means and said rig floor for suspending a second section of casing above the rig floor and above said suspended first section of casing;

a casing section stabbing and positioning means demountably connected to a side of the derrick at a location facilitating engagement by said stabbing and positioning means of a medial portion of said second section of casing, said casing stabbing and positioning means including:

a derrick bracket subassembly detachably connected to a side of said derrick;

a boom and jaw subassembly detachably connected to said derrick bracket subassembly, and including:

an elongated, extensible boom having a first end pivotally connected to said derrick bracket subassembly for pivotation of the boom about a horizontal axis, and further having a second end at the opposite end of said boom from said first end;

a pair of casing-engaging jaws pivotally mounted on the second end of said boom, said jaws each having a generally concave inner side, and said two arcuate jaws being movably connected to said second end of said boom for pivotation about a pair of spaced, substantially parallel axes as said jaws are swung in a converging movement, or in a diverging movement; and means for selectively pivoting said boom about said horizontal axis to raise and lower the second end of said boom which carries said jaws, and to elevate said boom to a location where it extends in a generally vertical direction;

means for selectively varying the length of said boom comprising:

a boom extending piston and cylinder subassembly located adjacent the boom and connected to the boom for increasing and decreasing the length of the boom;

radially adjustable roller means carried on the concave inner side of said arcuate jaws for selectively adjusting the diametric dimension defined inside said jaws to thereby facilitate stabbing casing sections suspended from said traveling crown block despite variations in the diametric sizes of said casing sections; and a piston and cylinder subassembly connected between said jaws for pivoting said jaws in a converging movement, or in a diverging movement; and a remote control assembly detachably connected to said boom and jaw subassembly, said remote control assembly including;

a plurality of electrically controlled hydraulic valves for selectively supplying hydraulic power fluid to said piston and cylinder subassemblies;

a remote hand operable control device located remote from said hydraulic valves of the remote control assembly and on said rig floor, said remote hand operable control device having a plurality of switches thereon; and a control cable connected between the remote hand operable control device and the electrically controlled hydraulic valves for transmitting control signals form the remote hand operable control device to the electrically controlled hydraulic valves;

means for supplying electrical power to the remote control assembly;

means for supplying hydraulic power fluid to said electrically controlled hydraulic valves; and means for returning hydraulic power fluid from said piston and cylinder subassemblies as said electrically controlled hydraulic valves are shifted.

7. A system for making up a vertically extending string of threadedly interconnected casing sections by serially threaded interconnection of casing sections in end-to-end vertically extending relation comprising:

a rig floor;

means suspending a first section of casing in a vertical orientation below the rig floor with the upper end stationary;

a derrick erected above said suspending means and having sides and an upper end spaced vertically above the rig floor at which said suspending means is located;

a traveling crown block supported in the upper end of the derrick and lowerable toward said suspending means and said rig floor for suspending a second section of casing above the rig floor and above said suspended first section of casing;

a casing section stabbing and positioning means demountably connected to a side of the derrick at a location facilitating engagement by said stabbing and positioning means of a portion of said second section of casing, said casing stabbing and positioning means including:

a derrick bracket subassembly detachably connected to a side of said derrick;

a boom and jaw subassembly connected to said derrick bracket subassembly, and including:

an elongated, extensible boom having a first end pivotally connected to said derrick bracket subassembly for pivotation of the boom about a horizontal axis, and further having a second end at the opposite end of said boom from said first end;

a pair of casing-engaging jaws pivotally mounted on the second end of said boom, said jaws each having a generally concave inner side, and said jaws being movably connected to said second end of said boom for pivotation about a pair of spaced, substantially parallel axes as said jaws are swung in a converging movement, or in a diverging movement; and means for selectively pivoting said boom about said horizontal axis to raise and lower the second end of said boom which carries said jaws, and to elevate said boom to a location where it extends in a generally vertical direction;

means for selectively varying the length of said boom comprising:

a boom extending piston and cylinder subassembly connected to the boo for increasing and decreasing the length of the boom;

adjustable roller means carried on the concave inner sides of said arcuate jaws for selectively adjusting the dimension defined inside of, and between said jaws, to thereby facilitate stabbing casing sections suspended from said traveling crown block despite variations in the diametric sizes of said casing sections; and a piston and cylinder subassembly connected to said jaws for pivoting said jaws in a converging movement, or in a diverging movement; and a remote control assembly including:

a plurality of power fluid control valves detachably mounted on said boom and jaw subassembly for selectively supplying power fluid to said piston and cylinder subassemblies;

manually operable means on said rig floor to facilitate remote manual control of said power fluid control valves; and flexible lines interconnecting said control valves and said manually operable means for supplying power fluid and control signals to said control valves from said manually operable means.

8. A system for making up a vertically extending string of interconnected casing sections comprising:

a drilling rig floor;

means located at the drilling rig floor for suspending a first section of casing in a vertical orientation below the rig floor, with the upper end of said suspended first section of casing maintained stationary;

a derrick erected above said suspending means and having sides and an upper end spaced vertically above the rig floor at which said suspending means is located;

a block supported in the upper end of the derrick and lowerable toward said rig floor for suspending a second section of casing above the rig floor and above said suspended first section of casing;

a casing section stabbing and positioning means demountably connected to the side of the derrick at a location facilitating engagement of said second section of casing by said stabbing and positioning means, said casing section stabbing and positioning means including:

a supporting frame means detachably connected to a side of said derrick;

a boom and jaw subassembly detachably connected to said supporting frame means and including:

an elongated, extensible boom having a first end pivotally connected to said supporting frame means for pivotation of the boom from a horizontally extending operable position to an upwardly extending parked position, and further having a second end at the opposite end of said boom from said first end;

a pair of casing-engaging jaws pivotally connected to the second end of said boom, said jaws each having a generally concave inner side, and said jaws being movably interconnected to each other and t the second end of said boom for pivotation about a pair of spaced, substantially parallel axes as said jaws are swung in a converging movement, or in a diverging movement;

means for selectively pivoting said boom about said horizontal axis to raise and lower the second end of said boom which carries said jaws, and to elevate said boom to a parked location where it extends in a generally vertical direction;

means for selectively varying the length of said boom comprising:

a boom extending piston and cylinder subassembly connected to the boom for increasing and decreasing the length of the boom;

adjustable roller means carried on the concave inner side of said arcuate jaws for selectively adjusting the dimension defined inside said jaws to thereby facilitate stabbing casing sections suspended from said block despite variations in the diametric sizes of said suspended casing sections; and a piston and cylinder means connected to said jaws for pivoting said jaws in a converging movement, or in a diverging movement; and a remote control assembly connected to said boom and jaw subassembly, said remote control assembly including:

a plurality of control valves for selectively supplying power fluid to said piston and cylinder subassemblies;

a remote hand operable control device located remotely from said control valves of the remote control assembly, and on said rig floor, said remote hand operable control device having a plurality of hand manipulatable control elements thereon;

control lines connected between the remote, hand operable control device and said control valves for transmitting control signals from the remote, hand operable control device to the control valves;

means for supplying power fluid to said control valves; and means for returning power fluid from said piston and cylinder subassemblies as said control valves are shifted.

* * * * *

UNITED STATES PATENT AND TRADEMARK OFFICE

CERTIFICATE OF CORRECTION

PATENT NO. : 5,049,020

DATED : September 17, 1991

INVENTOR(S) : James R. McArthur

It is certified that error appears in the above-identified patent and that said Letters Patent is hereby corrected as shown below:

Col. 7, line 11, after the word "its" insert -axis so that this type of motion can be accommodated when the--.

Col. 15, line 43, delete "us" and insert --use--.

Col. 17, line 4, after the word "present" insert -invention , it is not even necessary for the operator of the--.

Col. 24, line 21, delete "boo" and insert --boom--.

Col. 25, line 16, delete "t" and insert --to--.

Signed and Sealed this

Twenty-sixth Day of January, 1993

*Attest:*

STEPHEN G. KUNIN

*Attesting Officer*

*Acting Commissioner of Patents and Trademarks*